US006813863B2

(12) United States Patent
Duffy

(10) Patent No.: US 6,813,863 B2
(45) Date of Patent: Nov. 9, 2004

(54) AUTOMOBILE PROTECTION SYSTEM

(76) Inventor: James J. Duffy, ON324 Ethel St., Winfield, IL (US) 60190

( * ) Notice: Subject to any disclaimer, the term of this patent is extended or adjusted under 35 U.S.C. 154(b) by 0 days.

(21) Appl. No.: 10/288,864

(22) Filed: Nov. 6, 2002

(65) Prior Publication Data

US 2004/0083659 A1 May 6, 2004

(51) Int. Cl.[7] ..... G09F 7/18

(52) U.S. Cl. ..... 52/39; 52/174; 160/330; 256/65.03; 256/65.05; 256/65.16

(58) Field of Search ..... 52/39, 179, 173.1, 52/174; 256/59, 65.01, 65.03, 65.04, 65.05, 65.14, 65.16, 65.02; 160/330; 248/237; 267/139

(56) References Cited

U.S. PATENT DOCUMENTS

| | | | | |
|---|---|---|---|---|
| 1,126,243 | A | | 1/1915 | McQuown |
| 3,099,313 | A | | 7/1963 | Peck et al. |
| 3,610,669 | A | | 10/1971 | Morrissey, Sr. |
| 3,704,037 | A | | 11/1972 | Glassberg |
| 3,738,695 | A | | 6/1973 | McBee |
| 4,010,933 | A | | 3/1977 | Hebda |
| 4,014,583 | A | | 3/1977 | Forbes |
| 4,036,165 | A | | 7/1977 | Wood |
| 4,155,540 | A | | 5/1979 | Horgan, Jr. |
| 4,433,636 | A | | 2/1984 | Crouch |
| 4,490,917 | A | | 1/1985 | Pilling |
| 4,535,974 | A | | 8/1985 | Conde |
| 4,561,685 | A | | 12/1985 | Fischer |
| 4,571,903 | A | | 2/1986 | Strassner |
| 4,643,471 | A | * | 2/1987 | Fishback ..... 293/128 |
| 4,707,009 | A | | 11/1987 | Barnett |
| 4,750,767 | A | | 6/1988 | Barnett |
| 5,112,092 | A | | 5/1992 | Pucci |
| 5,149,166 | A | | 9/1992 | Wille et al. |
| 5,184,857 | A | | 2/1993 | Hawkins |
| 5,381,991 | A | * | 1/1995 | Stocker ..... 248/206.5 |
| 5,832,865 | A | | 11/1998 | Harmel |
| 5,992,343 | A | | 11/1999 | Drover |
| 6,112,478 | A | | 9/2000 | Piper |
| 6,209,478 | B1 | | 4/2001 | Curtis |
| 6,240,681 | B1 | | 6/2001 | Lyles et al. |

* cited by examiner

*Primary Examiner*—Carl D. Friedman
*Assistant Examiner*—Nahid Amiri
(74) *Attorney, Agent, or Firm*—Pyle & Piontek

(57) ABSTRACT

The automobile protection system for a multiple car garage comprises a cushion positioned between parking spaces of the garage, which cushion is suspended and sized to extend at least along the length of doors of cars parked in the spaces to keep the door of one car from striking the adjacent car when opened. Further, the cushion is suspended in a manner so as not to interfere with operation of an overhead door of the garage.

34 Claims, 10 Drawing Sheets

FIG. 3
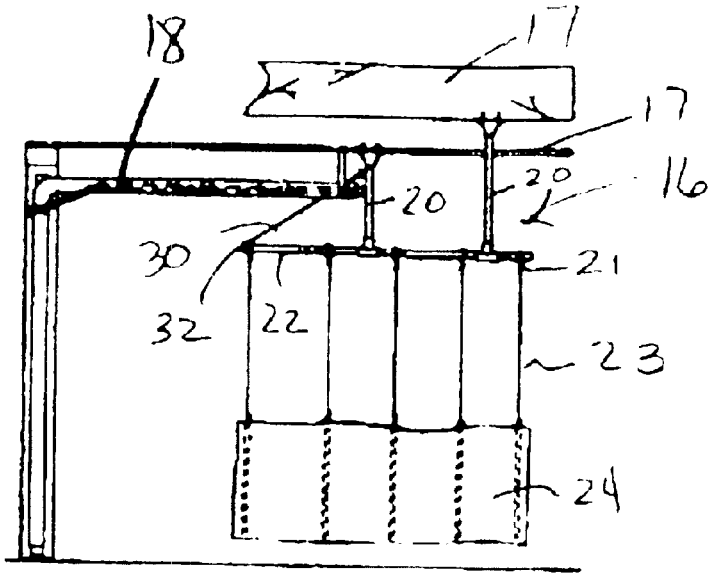
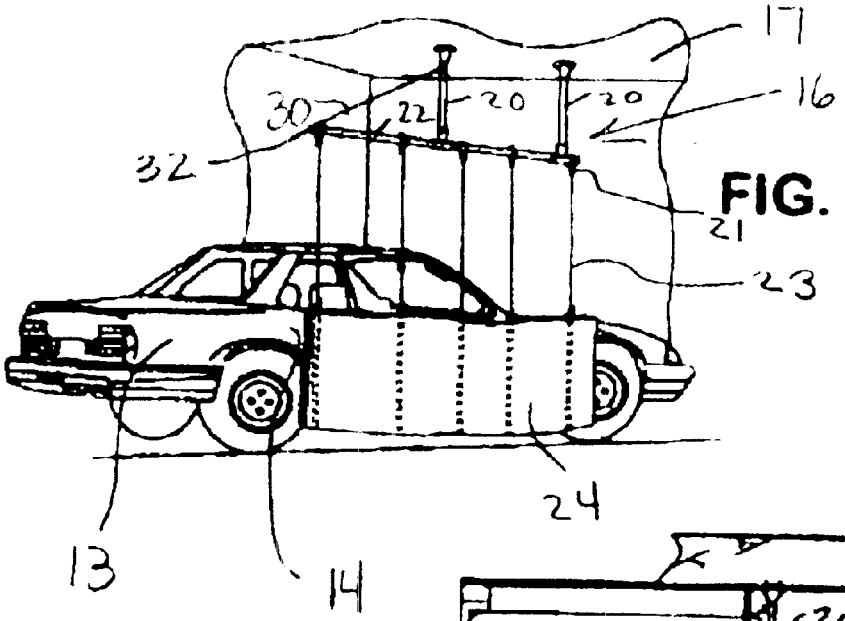
FIG. 4
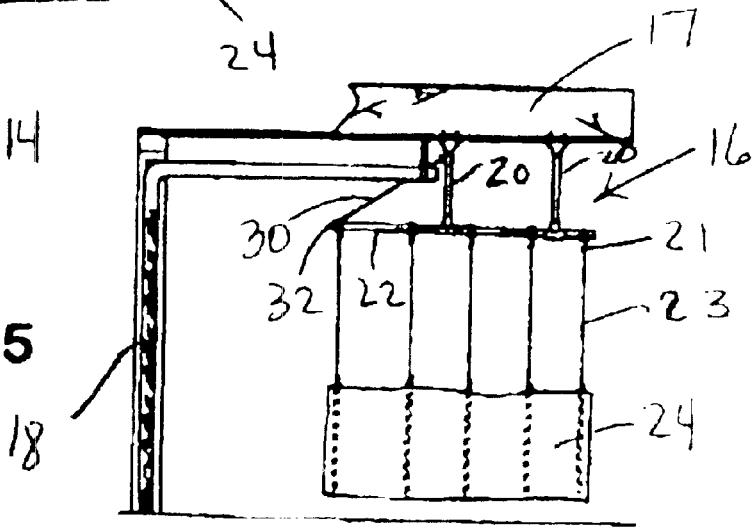
FIG. 5

FIG. 13
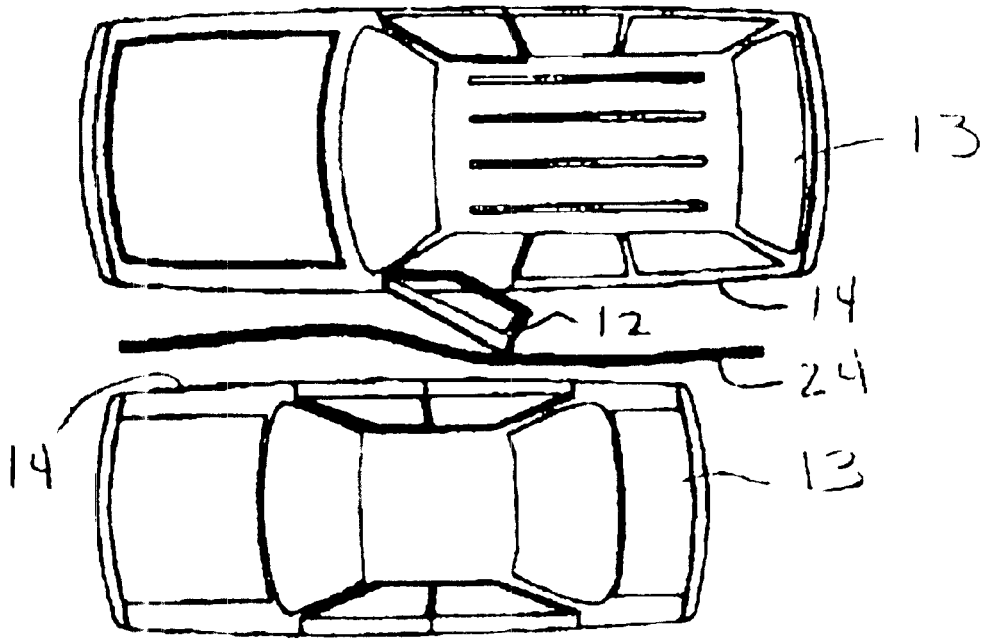
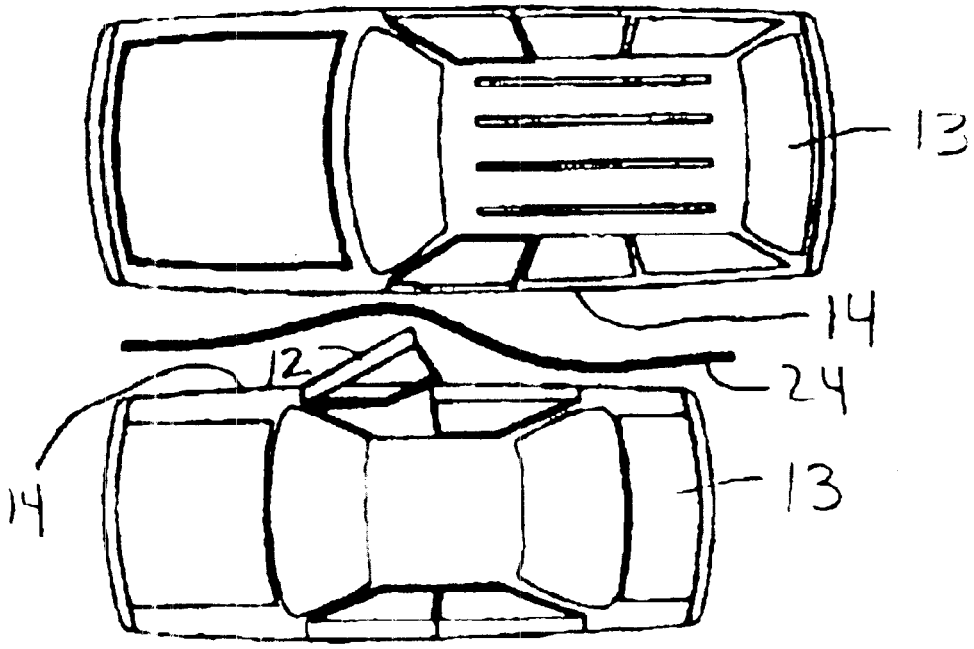
FIG. 14

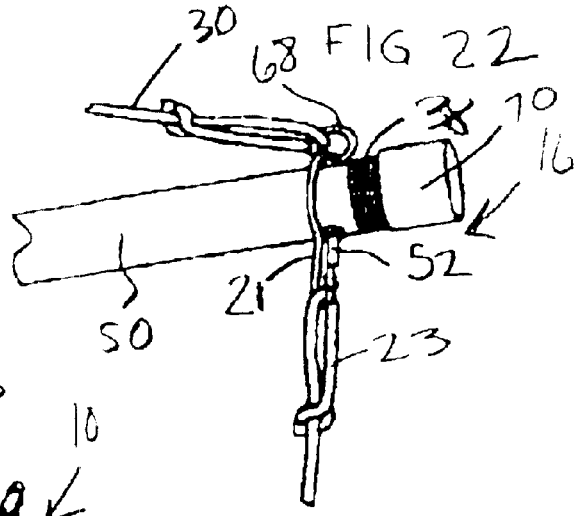
FIG. 21
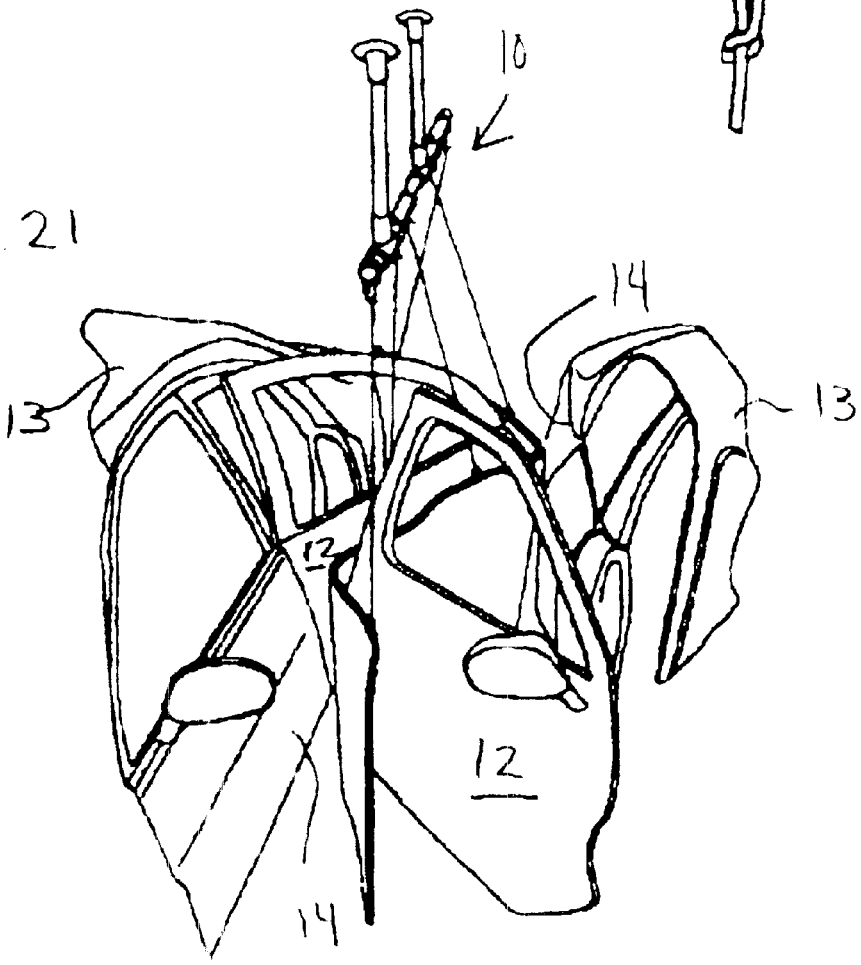

AUTOMOBILE PROTECTION SYSTEM

BACKGROUND OF THE INVENTION

The present invention relates to an automobile protection system. More particularly, the present invention relates to a cushion which is suspended in a manner to be positioned between adjacent vehicles in a multicar garage or parking spaces, such that opening of a door of one vehicle does not come into contact with the side of the adjacent vehicle but rather with the cushion, protecting the side of the vehicle against which the door of the other vehicle is opened from damage.

PRIOR ART

Various embodiments of such protectors have been proposed. However, none have been as versatile as that of the present invention which accommodates not only protection of automobiles but also accommodates full opening of an overhead garage door.

SUMMARY OF THE INVENTION

According to the invention there is provided an automobile protection system for a multiple car garage or parking spaces having at least a roof, sidewalls and an overhead door. The system includes a support structure or mounting bracket extending downward from a supporting object above the level of the top of the overhead door. The support structure is placed between adjacent car parking spaces and extends toward the overhead garage door, the support structure being located to permit the overhead garage door to completely open. A cushion extends downward from the support structure, the cushion being sized to extend along at least the length of the doors of cars parked in the parking spaces. The support structure is of a height sufficient to not interfere with a person entering a parked car, the cushion being flexible to accommodate and be moved by opening of a door of one of the parked cars, with the cushion rather than the opening door striking the adjacent parked car. Thus, two or more cars may be parked in adjacent parking spaces without the opening door of one car contacting the other car.

BRIEF DESCRIPTION OF THE DRAWINGS

FIG. 3 is a side elevational view into a garage showing the automobile protection system suspended therein with the garage door shown fully open.

FIG. 4 is a perspective view showing the automobile protection system adjacent at least the door area of a car parked to one side thereof FIG. 5 is similar to FIG. 3 but shows the garage door in a closed position thereof.

FIG. 13 is a top plan view showing the cushion flexing in one direction upon opening of a door of a first car adjacent the cushion.

FIG. 14 is a top plan view showing the cushion flexing in an opposite direction upon opening of a door of a second car adjacent the cushion.

FIG. 21 is a perspective view showing a front door of one vehicle to one side of the cushion and a rear door of an adjacent vehicle to another side of the cushion opened simultaneously with the cushion flexing to accommodate both situations.

FIG. 22 is an enlarged perspective view of one end of a support rod of the mounting bracket for the cushion to depend from and hanging structures by which the cushion depends from the rod.

DESCRIPTION OF THE PREFERRED EMBODIMENTS

Figure 1:
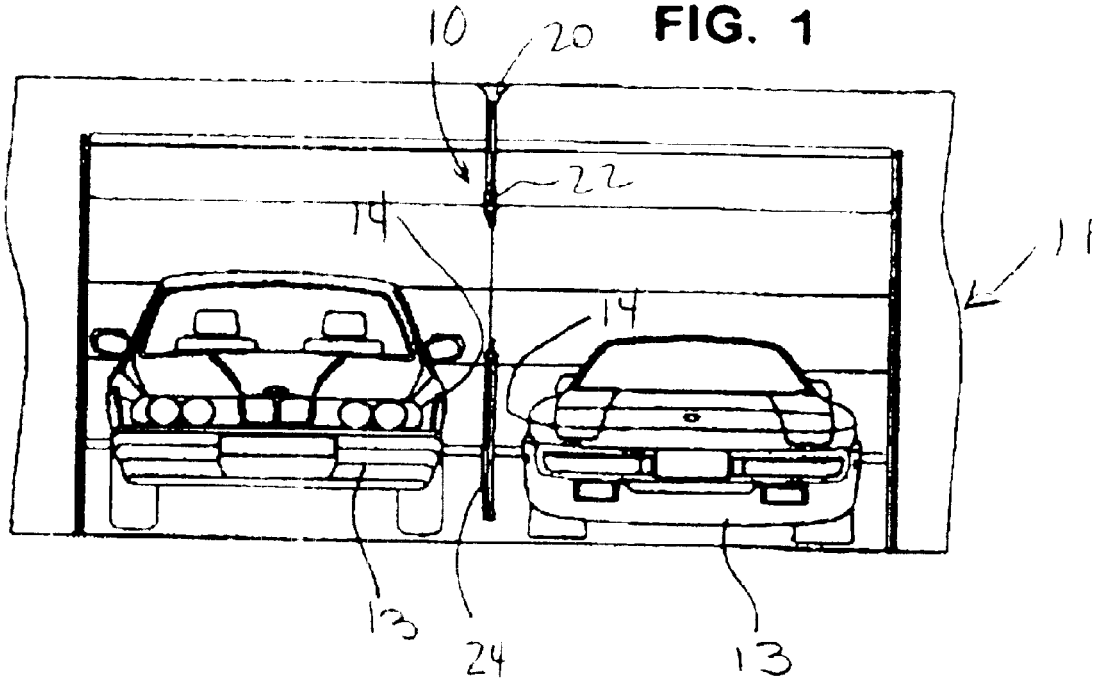
FIG. 1 is an elevational front interior view of a two car garage showing the automobile protection system of the present invention positioned between two cars parked in the garage.
Figure 2:
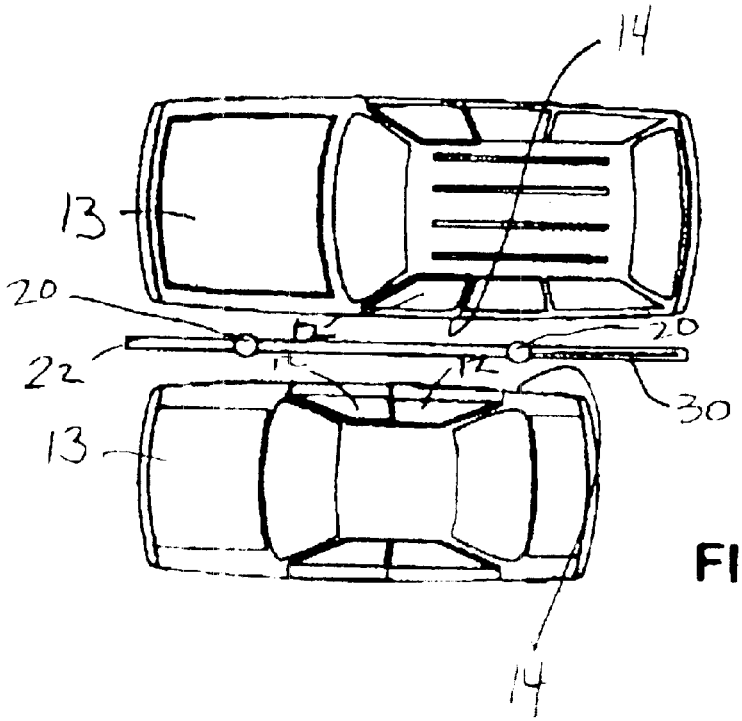
FIG. 2 is a top plan view showing the automobile protection system between two adjacent parked cars.

Referring now to the drawings in greater detail there is illustrated therein an automobile protection system of the present invention generally identified by the reference numeral 10 for use in multicar garages 11 to keep doors 12 of a first vehicle 13, upon opening, from contacting the side 14 of the adjacent vehicle 13, and causing dents, chips, etc. therein, which commonly takes place when an open door 12 of a vehicle 13 contacts an adjacent vehicle 13, as shown in FIGS. 1 and 2. Of course, the present invention also protects the opening of doors of the adjacent vehicle 13 from damaging the side of the first vehicle 13.

In FIGS. 3–5, the system 10 is better illustrated and shows same to incorporate a support structure member or mounting bracket 16 which is engageable to one or more fixed objects 17 such as an interior ceiling, the underside of the outer roof, overhead beam, etc. of the garage 11 or other parking structure, preferably above the level at which the garage door 18 lies in the horizontal plane when open. The system 10 can be hung from an object 17 lying in one plane or height, or from two objects 17 lying in different planes or at heights, as best shown in the FIG. 3.

The mounting bracket 16 comprises two uprights or support members 20, which engage a generally horizontal rod or third support member 22 to the objects 17 above the level of the open door 18. The horizontal rod 22 also includes a plurality of depending clips 21 which engage flexible means or hangers 23 such as rope, thread, chain, ribbon, etc. Engaged to the flexible hangers 23 is a cushion 24 which is elevated and oriented at a position between body sides 14 of the adjacent vehicles 13 such that door 12 opening takes place against the cushion 24 rather than the body side 14 of the adjacent vehicle 13.

Also it will be seen that an additional angled support 30 is also provided, engaged between an end 32 of the support rod 22 toward the garage door 18 and the upright 20 closest to the end 32 of the support rod 22, providing added stability to the system 10 and to prevent sagging of the horizontal rod 22. This angled support permits the cushion to extend well under the garage door without it interfering with the operation of the garage door.

Figure 6:
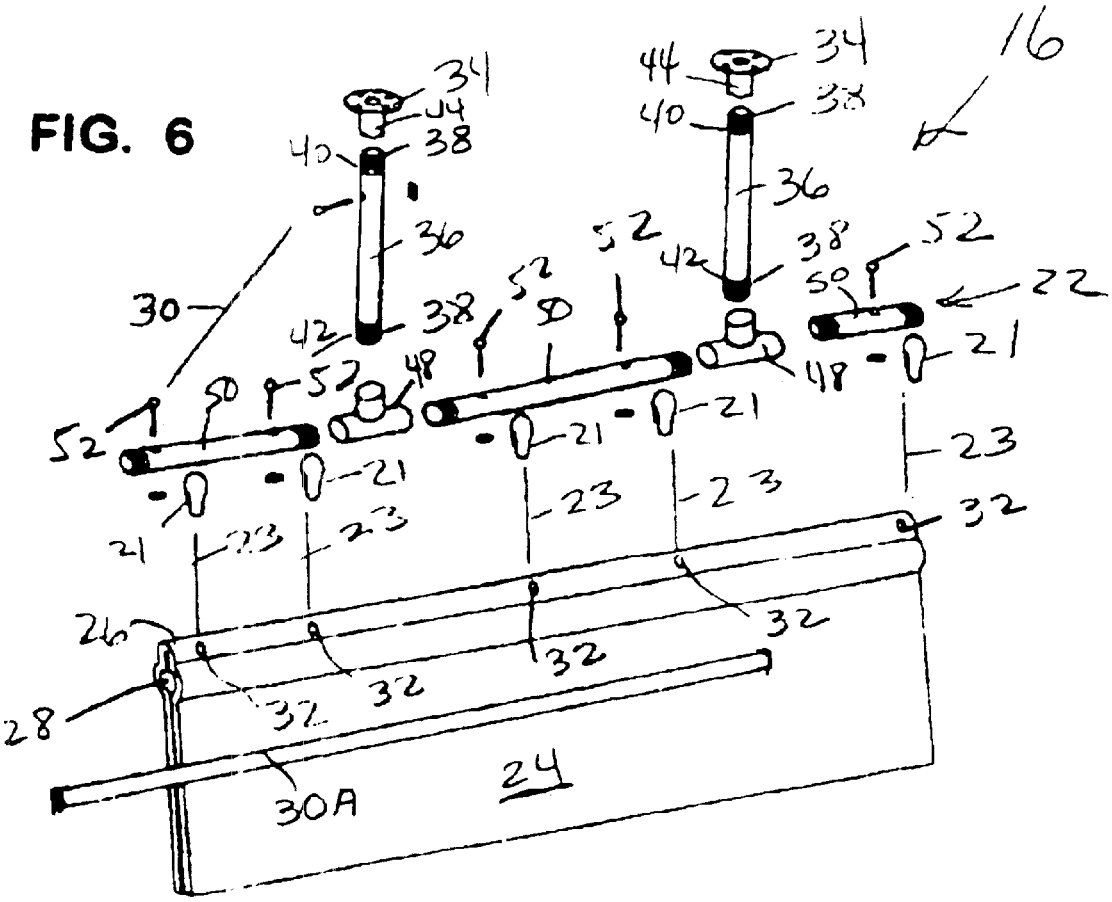
FIG. 6 is an exploded perspective view of the automobile protection system.
Figure 7:
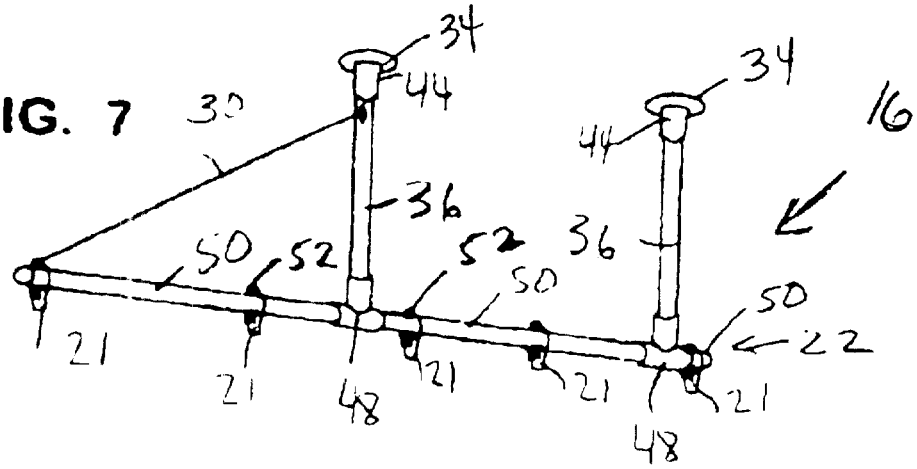
FIG. 7 is a perspective view of a support member or mounting bracket of the automobile protection system.

Turning to FIG. 6, it will be seen that the system 10 is created from multiple parts. The cushion 24 itself is double folded along an upper periphery 26 thereof and has a pocket 28 created adjacent the folded upper periphery 26 within which a firm yet flat, flexible element bar strip or rod 30A may be received. It should be understood that this flexible element is optional and not always necessary. This bar or rod could be made of steel, plastic or composite materials such as carbon fiber. The flexible strip or rod 30A should have vertical stiffness to help prevent sag of the cushion, but yet must permit the rod and cushion to flex horizontally to absorb door movement. Preferably, the rods cross section is generally many times higher (vertically) than it is thick (horizontal) to give it the desired flexibility and support. For example, the cross section could be 1 inch high and 0.04 inches thick. Also, here it will be seen that the hangers 23 depending from the clips 21 are engageable to the cushion 24 via openings 32 created in the upper periphery 26 above the pocket 28. Of course, other means than the clips and openings could be used.

Still further, it will be seen that the uprights 20 each comprise in the illustrated embodiment a base member 34 for use in engaging the mounting bracket 16 to the supporting object 17. The rod 36 of each upright may incorporate screw threads 38 at each end 40 and 42 thereof, the top screw threaded male end 40 being threadedly engaged into a threaded female portion 44 of the base 34. PVC pipe could be used to construct these members and can be obtained from a plumbing supply with such threads. As an alternative, the PVC pipe could be unthreaded and cut as required and bonded or cemented together. Further, these members could be made of metal pipe, other metal shapes or wood.

The opposite threaded end 42 of the rod 36 engages a T connector 48 to which a plurality of horizontal sections 50 of the horizontal rod 22 with the clips 21 thereon engage. The clips 21 may be fixed to the rod sections 50 by fasteners 52, if desired Although the various rods 36 and 50 are shown to be screw threaded, this should not be construed as limiting since all structures could just as easily be engaged to each other using a suitable adhesive, such as epoxy or the like, eliminating the need for threading of mating structures.

Figure 8:
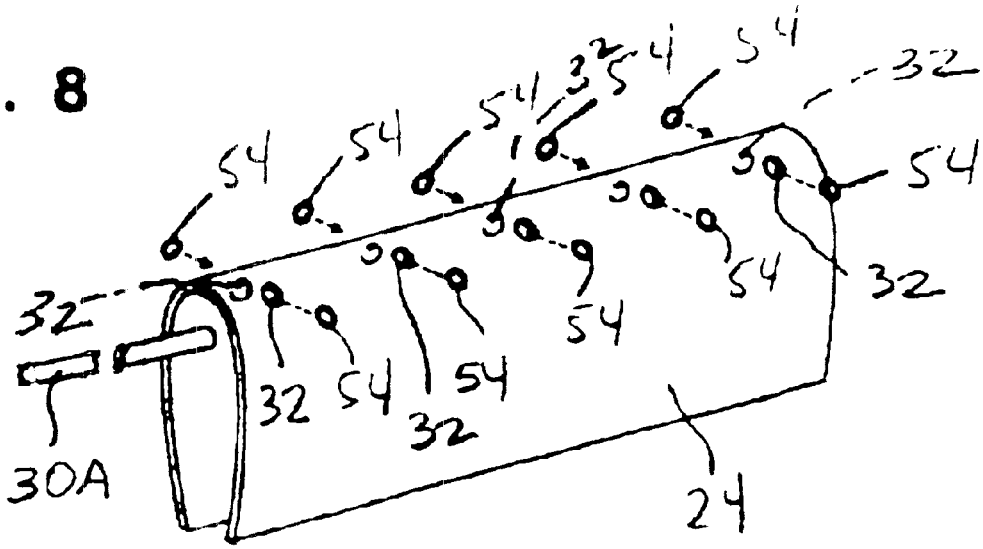
FIG. 8 is an exploded perspective view of a cushion of the automobile protection system.

In FIG. 8, it will be seen that grommets 54 surround and engage in each opening 32 in the folded upper periphery 26 of the cushion 24 so the material of the cushion 24 remains intact.

Figure 9:
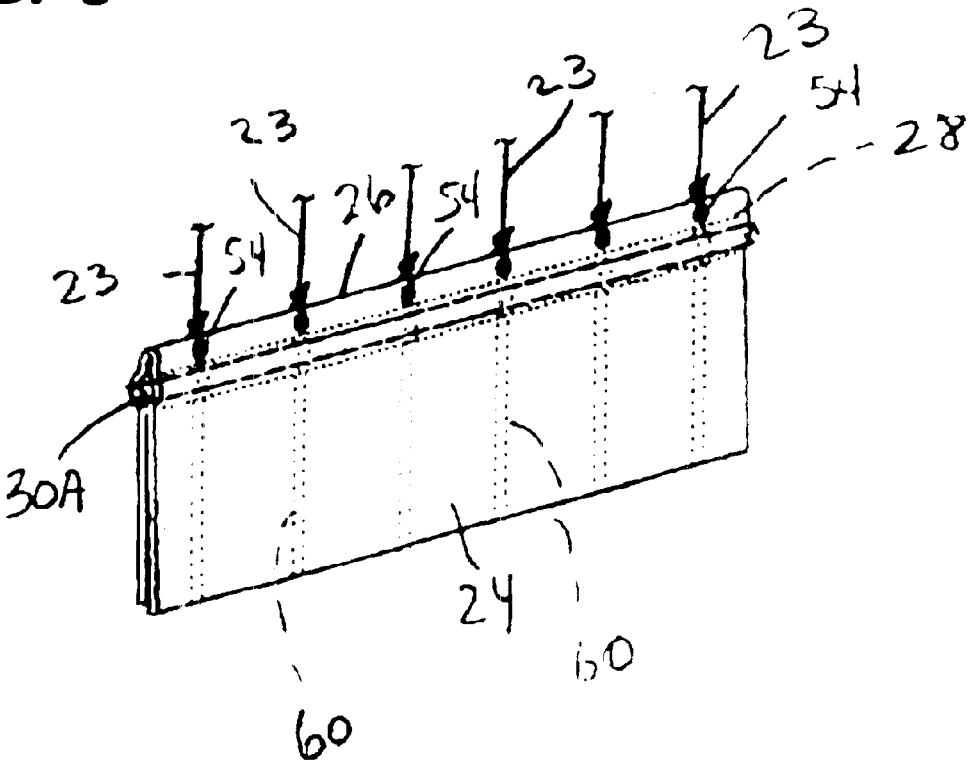
FIG. 9 is a perspective view of the assembled cushion and hangers therefor.

Then, the flexible hangers 23 can be engaged through the grommets 54 and fixed to the cushion 24, as shown in FIG. 9.

Also, as shown, the double thickness of the cushion 24 may be sewn, as at 60.

Figure 10:
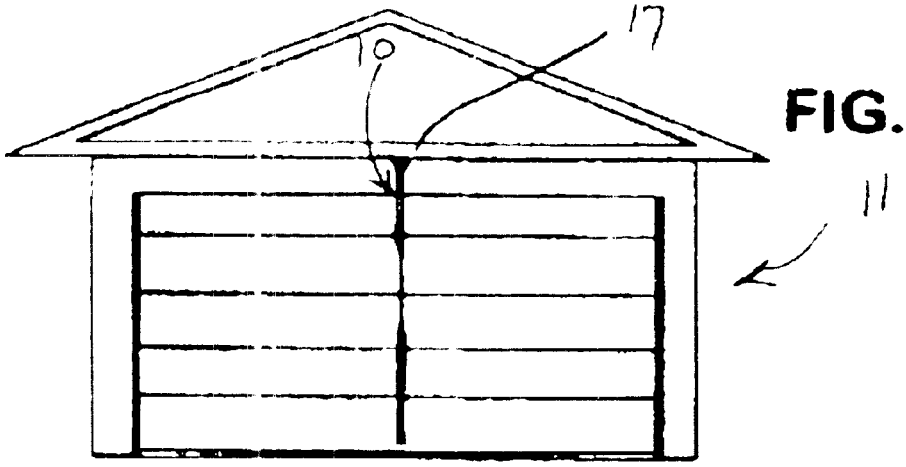
FIG. 10 is a front view of a garage showing the automobile protection system suspended from a first supporting surface or object of the garage.
Figure 11:
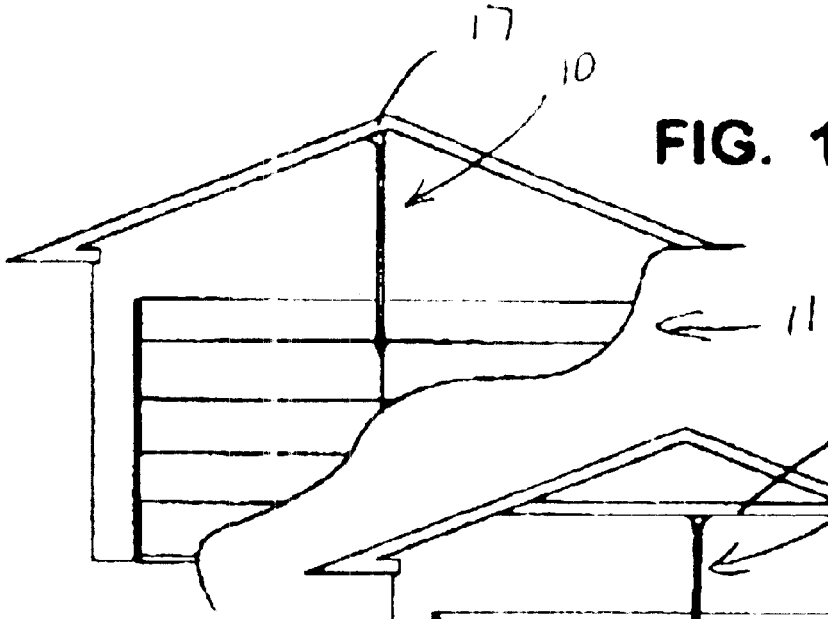
FIG. 11 is a partial front view of a garage showing the automobile protection system suspended from a second supporting surface or object of the garage.
Figure 12:
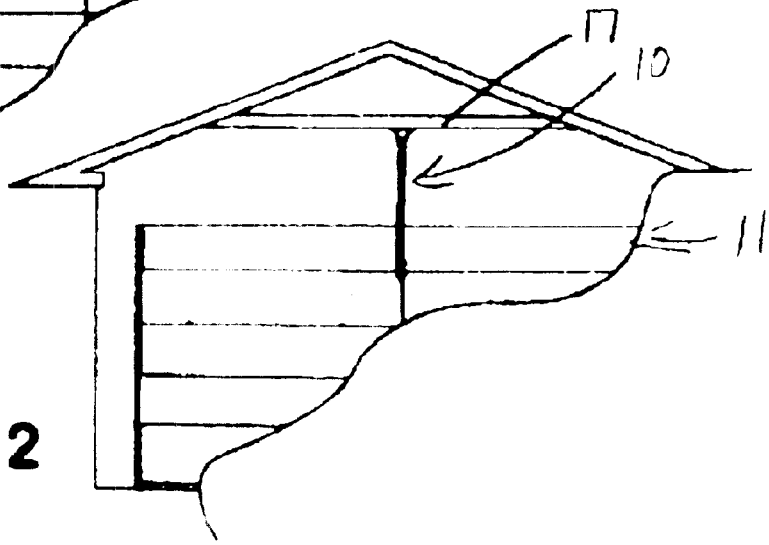
FIG. 12 is a partial front view of a garage showing the automobile protection system suspended from a third supporting surface or object of the garage.

FIGS. 10–12 show various garage support structures 17 to which the system 10 can be engaged, such as a ceiling 17 in FIG. 10, a roof 17 in FIG. 11 or a beam 17 in FIG. 12. Also, as noted earlier, the two supports need not be engaged similarly, but each could be engaged as needed or desired. It should be noted that one of the supports is at the rear of the garage while the other is at the front of the garage, but behind the rearmost portion of the open overhead garage door. The support system usually includes at least two support members. However, one suitably stiff, large support might be used, particularly with one or more angular supports at the front and rear. With two supports, the support members are spaced apart at least 25% the length of the automobile to be parked therein. The support member closest to the garage door is spaced a few feet or less behind the open garage door, the other or second support member being at least three feet behind the first support member. A third support member extends from at least the second support member past the first support member toward the garage door. The third member at its end nearest the garage door extends at least one foot under the open garage door.

FIGS. 13 and 14 show flexibility of the cushion 24 as the door 12 of a car 13 is opened thereagainst.

Figure 15:
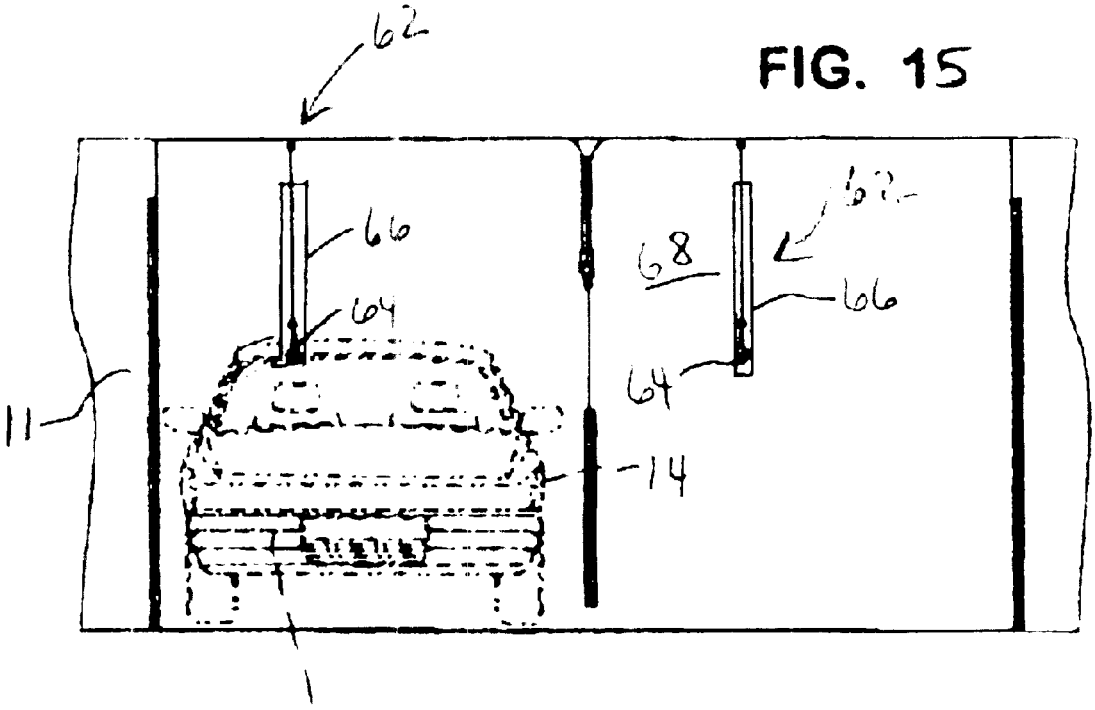
FIG. 15 is an elevational view of positioning elements of the automobile protection system cooperating with one parked car shown in phantom.
Figure 16:
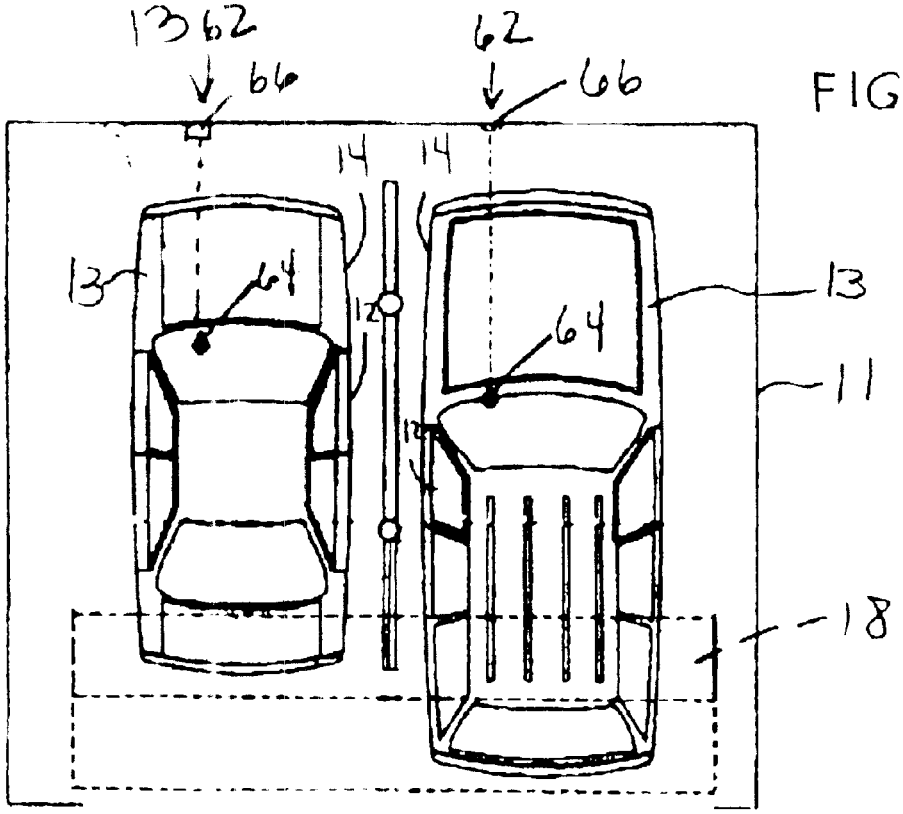
FIG. 16 is a top plan view showing another embodiment of positioning elements of the automobile protection system cooperating with each of two parked cars and shows the garage door open above the cars in phantom.

FIGS. 15 and 16 show the provision of a positioning apparatus 62 in the form of spaced indicia, for positioning the cars 13 appropriately relative to the system 10. Such positioning apparatus 62 is defined in greater detail in the description of the method of use below. It will be understood that the positioning apparatus 62 is not only used to make sure the car 13 is pulled far enough forward into the garage 11 but also to allow sufficient distance between the cushion 24 and the car door(s) 12 to allow one to enter via the door(s) 12 adjacent the cushion 24.

Figure 17:
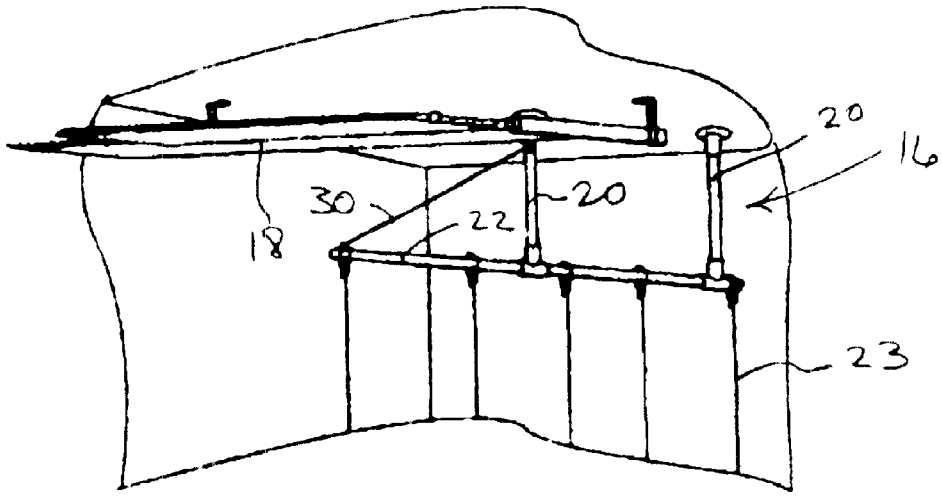
FIG. 17 is a perspective view showing the garage door completely open with the automobile protection system allowing complete opening thereof.

FIG. 17 is provided to show that the system 10 uprights 20 are positioned in such manner relative to the overhead garage door 18 so as not to interfere with its complete opening by placement of the upright 20 closest thereto just beyond the point the door 18 reaches upon complete opening.

Figure 18:
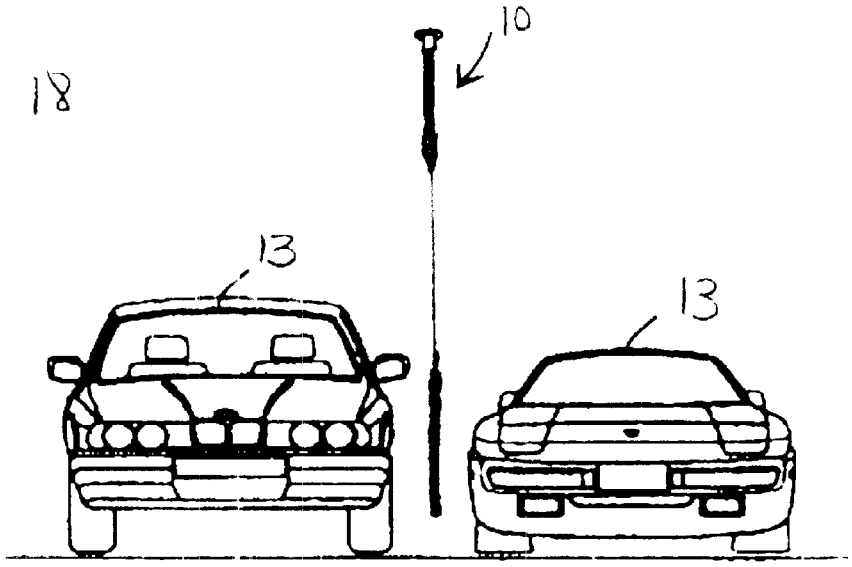
FIG. 18 shows the cushion of the automobile protection system depending between two adjacent vehicles.

FIG. 18 is provided to show that when the cars 13 are appropriately positioned using the positioning apparatus 62 (not shown in FIG. 18, but shown in FIGS. 15, 16, 19 and 20), entry and egress through the doors 12 (not shown) adjacent the cushion 24 are easily accommodated.

Figure 19:
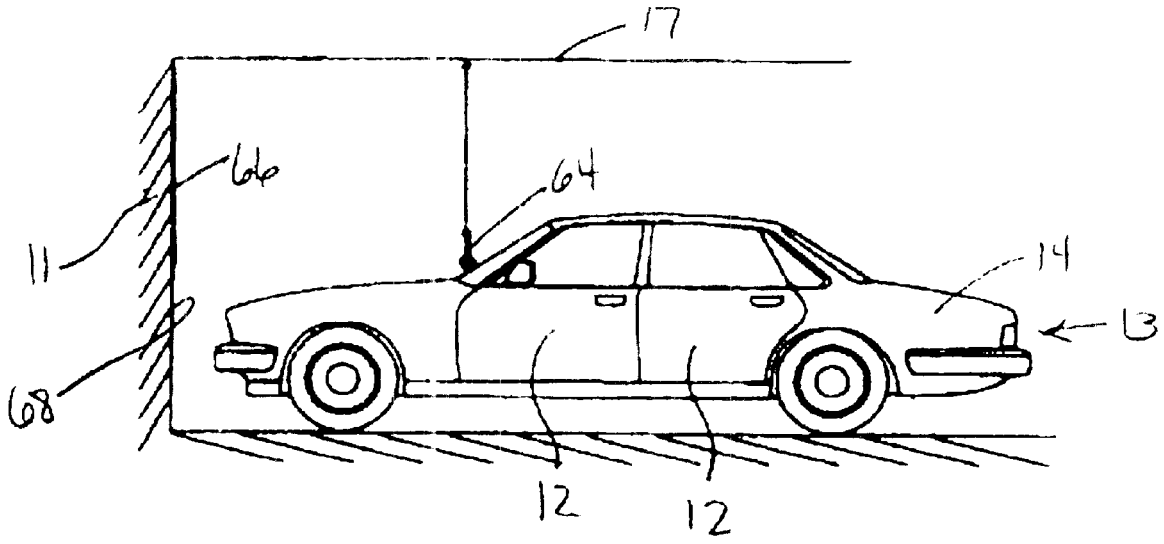
FIG. 19 shows the positioning elements for use with the automobile protection system with one element adjacent a windshield of a vehicle and the other on the wall.
Figure 20:
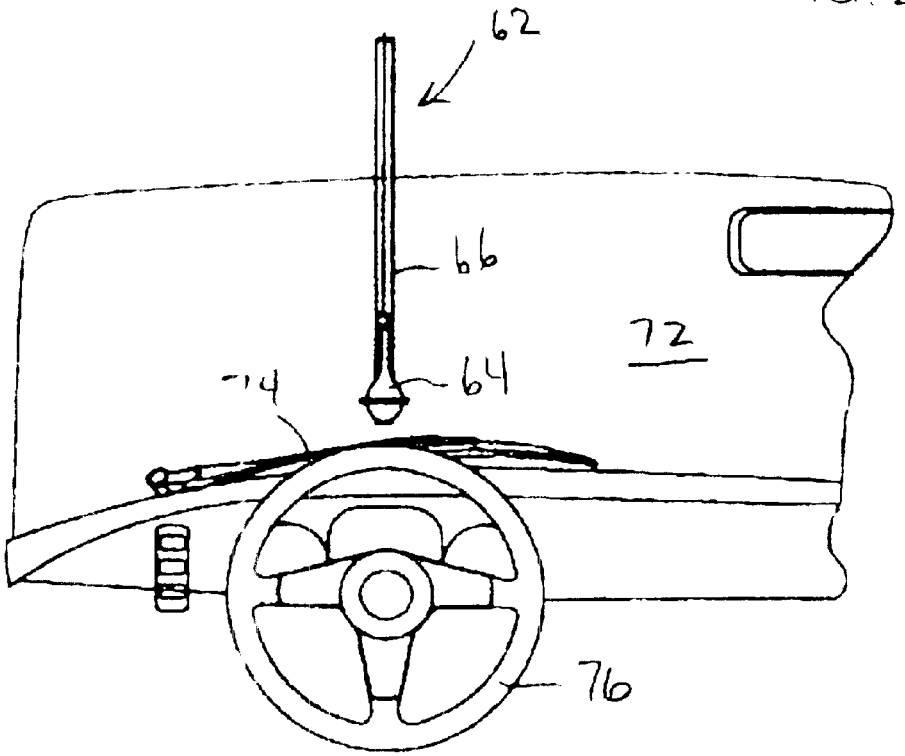
FIG. 20 shows the positioning elements of FIG. 19 as seen by a driver through the windshield.

FIGS. 19 and 20 show desired front to back alignment of the car 13 using one windshield engaging element 64 of the positioning apparatus 62, with FIG. 20, showing the driver's view of alignment of the windshield engaging element 64 in centered position relative to cooperating stripe 66 on the rear garage wall 68.

FIG. 21 shows that the cushion 24 can flex in two directions simultaneously in adjacent areas when doors 12 of both cars 13 adjacent thereto are opened simultaneously.

FIG. 22 is an enlarged partial view of one end 32 of the horizontal rod 22 showing the angleds support 30 engaged to an eye hook 68 engaged to the horizontal rod 22 and the clip 21. Also, if desired, end caps 70 to the horizontal rod 22 may be provided.

The method of installation is as follows:

Park vehicle 13 in desired location within the garage 11.

Engage windshield engaging positioning member 64 (forming one of the spaced indicia) to the ceiling 17 with the member touching the windshield 72 just above the windshield wiper 74 and centered over the steering wheel 76. The member 64 can be, for example, a ball hanging from a string or the like attached to the roof, ceiling or support beam.

Align the reflective tape 66 (forming the other of the spaced indicia) on the wall 68 in front of the vehicle 13, so when the driver is looking through the windshield 72, the member 64 is centered on the reflective strip 66.

Back one of the vehicles 13 out of the garage 11 and then drive it in using the positioning apparatus 62. When the windshield 72 strikes the member 64 and it is centered on the reflective strip 66 the car 13 should be properly parked. With the one vehicle 13 located, the above procedure is used to locate the other to be adjacently parked include in the adjacent space. This adjacent vehicle has its own locating elements 64 and 66.

While the invention was illustrated with respect to a two car garage, it could be used with a three car garage and/or any multi car garage or multi parking spaces, such as a parking lot.

As described above, the automobile protection system 10 provides a number of advantages some of which have been described above and others of which are inherent in the invention. Also, modifications including equivalent elements and/or steps can be proposed to the automobile protection system 10 without departing for the teachings herein. Accordingly the scope of the invention is only to be limited as necessitated by the accompanying claims.

What is claimed is:

1. An automobile protection system for a multiple car garage having multiple car parking spaces, a roof, sidewalls and an overhead door opening, and an overhead door for closing said overhead door opening, said overhead door opening and overhead door being sized to permit multiple cars to pass, comprising a support structure extending downward below the garage roof, said support structure being located between the multiple car parking spaces and extending toward the overhead garage door and with at least a portion of said support structure beneath the overhead door when in its open position, said support structure being located to permit said overhead garage door to be put in fully open position without contacting said support structure, a cushion extending downward beneath and from said support structure and with at least a portion of said cushion beneath the overhead when in its open position, said cushion being sized to extend along the length of the doors of cars parked in the parking spaces and a substantial distance toward said door opening and with at least a portion of said cushion beneath said overhead door when in its open position, said support structure being of a height sufficient to not interfere with a person entering a parked car, said support structure maintaining said cushion in position without movement when said overhead door is moved between its open and closed positions, said cushion being flexible in a horizontal direction to accommodate and be moved by opening a door of one of said parked cars, with said moving cushion and not said opening door striking the adjacent parked car, whereby two or more cars may be parked in said multiple parking spaces without the opening door of one car contacting the other car.

2. An automobile protection system as in claim 1, further comprising flexible means for supporting said cushion from said support structure.

3. An automobile protection system as in claim 2, wherein said flexible means is detachable from one of said support structure and said cushion.

4. An automobile protection system as in claim 3, wherein said flexible means is detachable from the other of said support structure and said cushion.

5. An automobile protection system as in claim 2, wherein said flexible means is one of rope, string, chain and ribbon.

6. An automobile protection system as in claim 3, wherein said flexible means is one of rope, string, chain and ribbon.

7. An automobile protection system as in claim 4, wherein said flexible means is one of rope, string, chain and ribbon.

8. An automobile protection system as in claim 3, wherein said flexible means includes detachable cooperating portions for one of said support structure and cushion.

9. An automobile protection system as in claim 1, wherein said support structure includes at least two support members, said first support members being spaced apart at least 25% the length of the automobile to be parked therein, said first support member being closest to the overhead door and being spaced a few feet or less behind the open overhead door when in its open position, the second support member being at least three feet behind the first support member, a third support member carried by the other two support members and extending from at least the support member and beyond the first support member towards the overhead door when in the closed position and beneath the overhead door when in its open position, said third support member at its end nearest the garage door extending at least one foot under the overhead door when in its open position, whereby the support structure can support a cushion extending beneath the open overhead door and not interfere with the opening of the overhead door.

10. An automobile protection system as in claim 9, wherein said first and support members extend generally vertically from and are attached to the roof of the garage.

11. An automobile protection system as in claim 10, wherein said roof of the garage is the exterior roof of the garage, and said first and second support members are attached to the interior of said exterior roof of the garage.

12. An automobile protection system as in claim 10, wherein said roof of the garage includes an interior ceiling of the garage, and said first and second support members are attached to said interior ceiling of the garage.

13. An automobile protection system as in claim 10, wherein said roof of said garage includes structural members supporting said roof, and wherein said first and second support members are attached to said structural members supporting the roof of said garage.

14. An automobile protection system as in claim 1, wherein said support structure is made of one of metal pipe, PVC pipe, metal shapes and wood.

15. An automobile protection system as in claim 1, wherein said support structure is made of one of metal pipe and PVC pipe, and said pipes are threaded together.

16. An automobile protection system as in claim 1, wherein said support structure is made of PVC pipe, and said pipe is bonded together.

17. An automobile protection system as in claim 1, including means for guiding each of said cars into the proper position with respect to said cushion.

18. An automobile protection system as in claim 17, wherein said means for guiding comprised spaced indicia in said garage.

19. An automobile protection system as in claim 17, wherein one of said indicia is spaced near the windshield of the car to be parked when in the parked position, and the other of said indicia is in front of the car when in the parked position.

20. An automobile protection system as in claim 18, including means to indicate wherein to stop the car.

21. An automobile protection system as in claim 19, including means to indicate wherein to stop the car.

22. An automobile protection system as in claim 19, wherein said first indicia is also said means to indicate wherein to stop the car.

23. An automobile protection system as in claim 19, wherein said first indicia and said means to indicate wherein to stop the car is a ball or the like which hangs in front of and immediately adjacent the windshield of the car when in the parked position.

24. An automobile protection system as in claim 23, wherein said cushion includes a flexible element which is relatively rigid vertically and flexible horizontally for holding said cushion in vertical alignment but yet permitting the cushion to deflect horizontally relative to itself when contacted by an opening door.

25. An automobile protection system as in claim 1, wherein said cushion includes a flexible element which is relatively rigid vertically and flexible horizontally for holding said cushion in vertical alignment but yet permitting the cushion to deflect horizontally relative to itself when contacted by an opening door.

26. An automobile protection system as in claim 25, wherein said cushion has means for receiving said flexible element.

27. An automobile protection system as in claim 26, wherein said means for receiving is a pocket formed in the top of said cushion.

28. An automobile protection system as in claim 27, wherein said flexible element is formed by strip of one of a spring steel, plastic and composite material.

29. An automobile protection system as in claim 24, wherein said flexible element is formed by strip of one of a spring steel, plastic and composite material.

30. An automobile protection system as in claim 9, wherein said first and second support members are generally vertical and said third support member is generally horizontal.

31. An automobile protection system as in claim 30, further comprising an additional angled support running from said first support member to adjacent the end of the third support member closest to the overhead door opening.

32. An automobile protection system as in claim 31, wherein said additional angled support runs at an angle to the horizontal and upwardly from said third support member toward said first support member.

33. An automobile protection system as in claim 9, wherein said third support is generally horizontal and comprising an additional angled support running from said first support member to adjacent the end of said third support member closest to the overhead door opening and further including a pair of spaced indicia for each of the multiple cars, of each pair of indicia being located in front of the windshield of each of the multiple cars and its associated indicia of its pair being located in front of said car, said indicia locating the car relative to the cushion and indicating where to stop the each of the cars.

34. An automobile protection system as in claim 9, further comprising and additional angled support comprises a flexible member detachably secured to at least one of the first support member and third support member.

* * * * *

UNITED STATES PATENT AND TRADEMARK OFFICE

CERTIFICATE OF CORRECTION

PATENT NO. : 6,813,863 B2
DATED : November 9, 2004
INVENTOR(S) : James J. Duffy

It is certified that error appears in the above-identified patent and that said Letters Patent is hereby corrected as shown below:

Column 5,
Line 39, after "in" insert -- its --

Signed and Sealed this

Seventeenth Day of May, 2005

JON W. DUDAS
*Director of the United States Patent and Trademark Office*